United States Patent [19]

Milgram

[11] 3,938,704

[45] Feb. 17, 1976

[54] INFLATION CONTROL VALVES

[75] Inventor: Jerome H. Milgram, Cambridge, Mass.

[73] Assignee: Offshore Devices, Inc., Lynn, Mass.

[22] Filed: May 23, 1974

[21] Appl. No.: 472,620

[52] U.S. Cl. ..... 222/5; 137/68 R

[51] Int. Cl.[2] ..... B67B 7/24

[58] Field of Search ..... 222/5, 80–83.5, 222/394, 83; 9/316, 318, 319, 320, 32; 244/149, 150; 137/68, 69

[56] References Cited

UNITED STATES PATENTS

| | | | |
|---|---|---|---|
| 3,248,010 | 4/1966 | DeBoer | 222/5 |
| 3,507,468 | 4/1970 | Lancaster | 244/150 |
| 3,591,877 | 7/1971 | Schuler | 222/5 X |

*Primary Examiner*—Allen N. Knowles
*Attorney, Agent, or Firm*—Robert E. Ross

[57] ABSTRACT

There is disclosed in the application a valve including a body in which is slidably mounted a cam-actuated puncturing pin for piercing the seal of a pressurized gas supply container. The body includes a passage for conducting gas from the supply to an inflatable device and a normally open passage for venting the device while it is in a deflated state. Rotation of the cam is accomplished by a detachably coupled lanyard and the cam includes a restraint against inadvertent rotation and a coupling to the pin to prevent accidental operation until inflation is desired. In addition, a projection of the cam engageable by the pin prevents return motion of the cam once its puncturing tool actuation has started.

4 Claims, 5 Drawing Figures

INFLATION CONTROL VALVES

The present invention relates generally to improvements in valves and more specifically to valves for controlling the inflation of floating gear from pressurized gas containers.

The transportation, deployment and inflation of very large inflatable devices such as floating barriers to contain oil spills on water presents special problems in the requirements of control valve performance and reliability. Thus, the valve must offer security against premature inflation while the barrier is being transported, frequently by air, in assembled but uninflated condition to the scene of an oil spill. Because of the size of such a barrier when fully inflated, its premature inflation, should it occur accidentally, could cause very serious problems aboard an aircraft. In addition, the construction of the control valve must be such that during the deployment of the barrier, there is a high degree of reliability that the inflation will take place when needed. A typical barrier assembly may include as many as 100 separate flotation units with individual valves and containers, may have a weight of several tons and when deployed, a length of over 200 yards. Failure of a substantial number of units to become inflated could result in a very substantial loss from the sinking of the uninflated barrier together with a multiplicity of gas supply cylinders. In addition, the delay in obtaining and deploying a replacement barrier causes additional spreading of the oil spill thereby rendering the oil recovery operation more difficult and costly by a substantial factor. Even the failure to inflate a single flotation unit is serious in that this creates a gap in the barrier through which oil escapes thereby rendering the recovery of the oil difficult if not impossible.

It is accordingly an object of the present invention to provide an inflation control valve which is highly reliable both to prevent premature inflation and to assure inflation when it is required.

Another object is to provide a control valve in which the reliability usually in assembled condition is maintained over an extended period of time while the valve may be installed before operation is needed.

The foregoing objects are achieved in accordance with the present invention by a valve including a body in which is mounted a puncturing pin for piercing the rupturable seal of a pressurized gas container. According to a feature of the invention, the puncturing pin is driven to its seal-piercing position by a lanyardactuated cam including a retaining projection which engages a neck in the pin to prevent its movement toward the seal until the cam is rotated. According to another feature of the invention, the cam is retained against rotation by a shear pin and thereby maintains its hold on the puncturing pin until there is applied to the lanyard sufficient force to produce cam rotation, a force of sufficient magnitude that it is not likely to be applied accidentally. In addition, the contour of the cam includes a hook engageable by the head of the pin after the cam has been rotated through a part of its travel so that it cannot thereafter return to its starting position.

The foregoing objects and features will be more fully understood from a detailed description of an illustrative embodiment taken in connection with the accompanying drawings in which.

Figure 1:
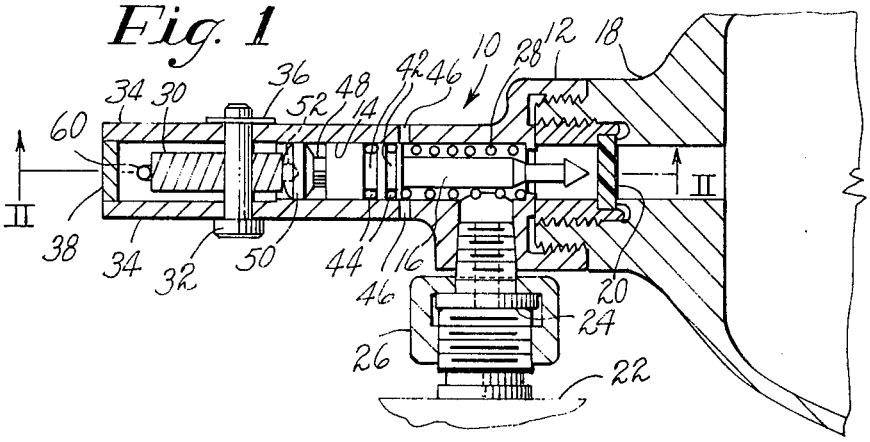
FIG. 1 is a view in longitudinal section of an inflation control valve according to the present invention.

Turning now to the drawings, there is shown a control valve according to the invention including a body 10 having an integral internally threaded inlet coupling 12 communicating with a cylindrical guideway 14 in which is slidably mounted a puncturing pin 16. The valve body 10 is screwed to the neck of a pressurized gas container 18, usually filled with carbon dioxide, which is sealed by a frangible disc 20. The guideway 14 is shouldered at the bottom and includes a reduced diameter for passage of the pin 16 and after piercing of the seal 20 for conducting the gas from the container 18 to an inflatable device 22. The path of the gas from the container 18 to the device 22 is through a headed conduit 24 which is threaded into the body 10 and carries an internally threaded coupling 26 for joining the valve to the device.

Figure 2:
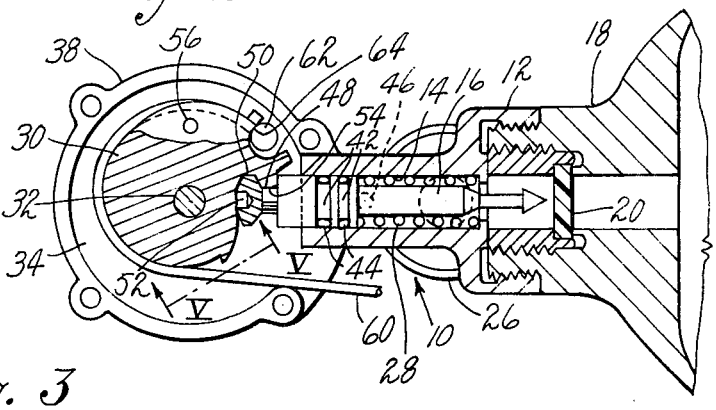
FIG. 2 is a view in cross-section taken along the line II—II of FIG. 1 and showing the relationship of a seal puncturing pin and its actuating cam before operation of the valve.

Surrounding a reduced diameter of the pin and interposed between the shoulder at the bottom of the guideway 14 and an enlarged guide diameter of the pin 16 is a compression spring 28 which urges the pin 16 away from the diaphragm 20 and into engagement with a cam 30 shown in its inactive position in FIG. 2. The pin 16 is retained against motion toward the diaphragm 20 by the cam 30 which is rotatable on a headed pivot 32 passing loosely through sideplates 34 and retained by a cotter pin 36. The plates 34 are integral with the body 10 and provide an enlarged enclosure for the cam 30, which is peripherally closed by a C-shaped housing member 38 secured by screws to the side plates. The pin 16 is formed with a pair of spaced-apart grooves 42 into each of which is received an elastomeric O-ring 44 for sealing the guideway 14 against the passage of gas from the container 18 when the seal 20 is ruptured. While the pin 16 is retained in the position depicted in FIGS. 1 and 2, however, the interior of the device 22 is exposed to its environmental atmosphere through a pair of ports 46 which become sealed off by the enlarged portion of the pin and the O-rings 42 when the pin moves to its seal piercing position. One of the reasons for the ports 46 is to allow venting to prevent inflation of the device from air remaining in it when it is taken to the low atmospheric pressure environment of high altitude. More importantly, the ports 46 permit the escape of gas from the container 18, if the diaphragm 20 should burst because of excessive internal pressure such as may be produced by a rise in temperature.

The pin 16 is provided with a neck 48 which defines a head 50 having a cam-contacting surface in which is formed a shallow socket 52. The cam 30 has a projection 54 which enters into the neck 48 while the cam is in the position depicted in FIG. 2 and thereby prevents accidental movement of the pin 16 to its disc piercing position depicted in FIG. 3, unless the cam 30 is rotated in a counter-clockwise direction from the position of FIG. 2. Such rotation, however, is prevented from occurring accidentally by means of a shear pin 56 which passes through both the cam and the sideplates 34. The pin 56 must first be broken so that the cam is permitted to turn for imparting a diaphragm piercing motion to the pin 16. Rotation of the cam is accomplished by means of a stainless steel cable lanyard 60 detachably coupled to and disposed around a portion of the periphery of the cam. The package containing the barrier assembly, gas containers and valves is frequently subjected to substantial shock loads during air and water transportation. The coupling of the cam 30 to the pin 16 and the retention of the cam against rotation by the shear pin 56 substantially eliminates any possibility of premature inflation as a result of the operation of the pin 16 under such shock loads. The coupling is accomplished by means of a ball 62 on the end of the lanyard, placed in a recess in the cam and bearing against an abutment 64. A part of the periphery of the cam is formed with a groove 66 as seen in FIG. 4 to receive and centralize the lanyard on the cam surface. In order to cause rotation of the cam, the lanyard 60 may be pulled in a direction generally parallel to the axis of the pin 16 generally coinciding with the axis of the cartridge 18 which is most often cylindrical in shape. However, because the lanyard bears against the end of the member 38 as seen in FIG. 2 a considerable latitude is permissible in the direction of pull to cause the rotation of the cam. This is a substantial advantage since on many occasions, the pull on the lanyard 60 is obtained by the weight of the cartridge 18, the valve and the device 22 suspended from the lanyard the free end of which is retained aboard a boat as the package is dropped into the water or as the package is pulled away from the boat.

Figure 3:
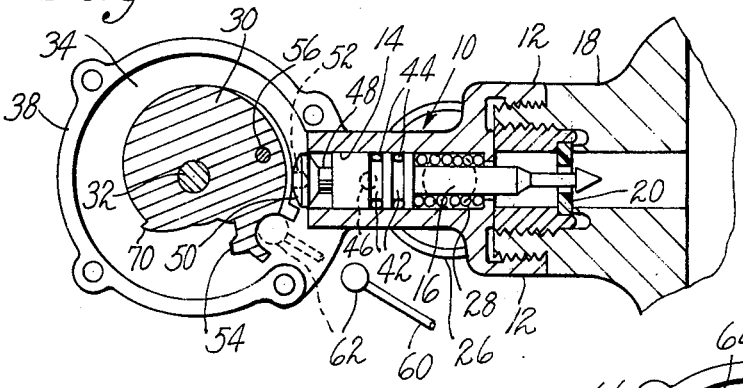
FIG. 3 is a view similar to FIG. 2 but showing the cam having been rotated into a position for causing the pin to pierce the seal.
Figure 4:
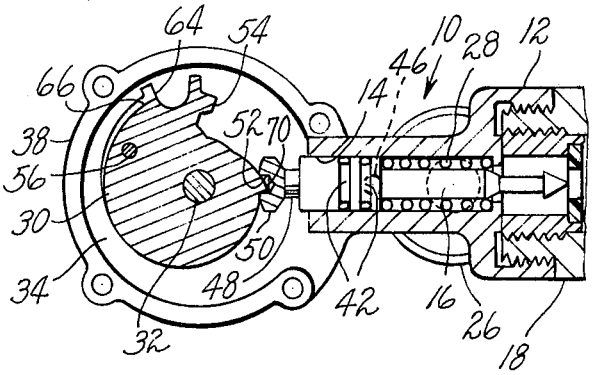
FIG. 4 is a view similar to FIGS. 2 and 3 but showing the cam in an intermediate position from which the cam is restrained against return to its original starting position.
Figure 5:
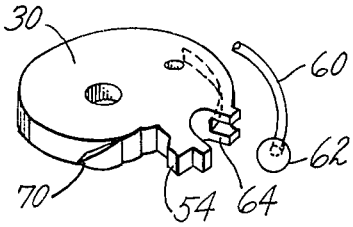
FIG. 5 is a fragmentary view in perspective taken generally along the line V—V of FIG. 2 and showing a cam surface for preventing reverse motion of the cam once the position of FIG. 4 has been reached.

The shape of the cam 30 is such as to advance the pin 16 from the position depicted in FIG. 2 to that of FIG. 3 for piercing the disc 20. When the pin 16 is in the position depicted in FIG. 2, the ports 46 are open to permit venting of the interior of the device 22 to its surrounding atmosphere. As the pin 16 travels from the position of FIG. 2 to that of FIG. 3, however, the enlarged portion of the pin and the O-rings 44 close off the ports 46 to prevent the escape of gas from the cartridge 18 to atmosphere as the gas is directed to device 22.

In order to prevent reverse motion of the cam 30 after it has been pulled by the lanyard 60 part way in its pin advancing direction, the cam is formed in its contour with a hook 70 to engage the socket 52 in the head of the pin after the cam has moved through approximately 60°. The shape of the hook is such that the cam may readily continue to move in a counter-clockwise direction with continued pull upon the lanyard 60 but the engagement of the hook 70 with the socket 52 prevents reverse motion of the cam 30 under the force of the spring 28 if the pull on the lanyard is temporarily released once the point of engagement of the hook with the socket is reached. This arrangement of the hook 70 and the socket 52 prevents return motion of the pin 16 after puncturing which would allow the gas to escape from the container 18 without inflating the device 22.

Having thus disclosed my invention, what I claim as new and desire to secure by letters Patent of the United States is:

1. A valve for controlling the inflation of a device from a pressurized gas container having a frangible diaphragm closure, comprising a body formed with an interior guideway, a puncturing pin slidably retained in the guideway for movement toward and away from the diaphragm, means including a cam for advancing the pin to puncture the diaphragm, and a lanyard for imparting rotary motion to the cam, said lanyard having a fixed end with an enlarged member disposed in a recess in the cam, said lanyard extending around a portion of the periphery of the cam to a free end which extends away from the cam, said enlarged member and said recess being so shaped and dimensioned that when the free end of the lanyard is pulled, rotary motion is imparted to the cam by the enlarged member to force the pin to advance to puncture the diaphragm and the enlarged portion separates from the recess automatically thereafter when the recess becomes aligned with the direction of pull of the lanyard to thereby release the lanyard from the cam.

2. A valve for controlling the inflation of a device from a pressurized gas container having a frangible diaphragm closure, comprising a body formed with an interior guideway, a puncturing pin slidably retained in the guideway for movement toward and away from the diaphragm, means including a cam for advancing the pin to puncture the diaphragm and means on said cam engaging said pin so as to prevent advance of the puncturing pin until the cam has been rotated.

3. A valve as set out in claim 2 in which the end portion of said pin adjacent the cam has a recess spaced from the end forming a shoulder, and the cam has a boss disposed in the recess for bearing against the shoulder to prevent forward movement of the pin until the cam has been rotated to remove the boss from the recess.

4. A valve for controlling the inflation of a device from a pressurized gas container having a frangible diaphragm closure, comprising a body formed with an interior guideway, a puncturing pin slidably retained in the guideway for movement toward and away from the diaphragm, means including a rotatable cam for engaging the rear end of the pin to advance the pin to puncture the diaphragm, the said rear end of the pin having a center recess and a forwardly sloping periphery, and said cam having a protuberance shaped and dimensioned to seat in said recess and prevent reverse rotation of the cam but allow further forward rotation thereof.

* * * * *